US008282264B2

(12) United States Patent
Dazin

(10) Patent No.: US 8,282,264 B2
(45) Date of Patent: Oct. 9, 2012

(54) ELONGATED VIBRATOR MADE IN SEVERAL DETACHABLE ELEMENTS ASSEMBLED WITH EACH OTHER THROUGH SECURED CONNECTIONS

(75) Inventor: Guillaume Dazin, Champagne sur Oise (FR)

(73) Assignee: P T C, Noisy le Sec (FR)

( * ) Notice: Subject to any disclaimer, the term of this patent is extended or adjusted under 35 U.S.C. 154(b) by 620 days.

(21) Appl. No.: 12/491,777

(22) Filed: Jun. 25, 2009

(65) Prior Publication Data

US 2009/0324345 A1 Dec. 31, 2009

(30) Foreign Application Priority Data

Jun. 25, 2008 (FR) ..... 08 03578

(51) Int. Cl.
*E02D 3/054* (2006.01)
*B01F 11/00* (2006.01)

(52) U.S. Cl. ..... 366/122; 405/271

(58) Field of Classification Search ..... 366/108, 366/120–123, 128; 74/87; 405/271
See application file for complete search history.

(56) References Cited

U.S. PATENT DOCUMENTS

| | | | | | |
|---|---|---|---|---|---|
| 2,059,239 | A | * | 11/1936 | Corwill | 366/122 |
| 2,116,708 | A | * | 5/1938 | Niekamp | 366/123 |
| 2,492,431 | A | * | 12/1949 | Kroeckel | 366/122 |
| 2,597,505 | A | * | 5/1952 | Lindkvist | 366/121 |
| 2,951,681 | A | | 9/1960 | Degen | |
| 2,967,048 | A | * | 1/1961 | Fontaine | 366/123 |
| 3,042,386 | A | * | 7/1962 | Wyzenbeek | 366/122 |
| 3,061,278 | A | * | 10/1962 | Dreyer | 366/122 |
| 3,410,528 | A | * | 11/1968 | Clark et al. | 366/123 |
| 3,865,501 | A | * | 2/1975 | Kniep | 405/271 |
| 4,006,886 | A | * | 2/1977 | Elliott | 366/123 |
| 4,057,222 | A | * | 11/1977 | Lyle | 366/123 |
| 5,829,874 | A | * | 11/1998 | Breeding | 366/120 |
| 2009/0324345 | A1 | * | 12/2009 | Dazin | 405/271 |
| 2012/0092948 | A1 | * | 4/2012 | Heimbruch et al. | 366/128 |

FOREIGN PATENT DOCUMENTS

| | | | |
|---|---|---|---|
| CN | 200 955 144 | | 10/2007 |
| CN | 201 077 981 | | 6/2008 |
| EP | 2138637 | A1 * | 12/2009 |
| FR | 2 317 421 | | 2/1977 |
| GB | 753 132 | | 7/1956 |
| GB | 1 521 627 | | 8/1978 |
| JP | 2001-227165 | * | 8/2001 |

OTHER PUBLICATIONS

French Search dated Jan. 26, 2009, from corresponding French application.

* cited by examiner

*Primary Examiner* — Charles E Cooley
(74) *Attorney, Agent, or Firm* — Young & Thompson

(57) ABSTRACT

A vibrator includes a tubular element including one or more sections, the upper end of which is provided with an element for suspension from a hoisting and/or guiding machine and the lower end of which is connected to an endpiece successively including a damper-isolator, a generator of vibrations (4) and a tip (5). This vibrator is made in several detachable elements assembled end-to-end by an element of a plurality of fixing screws (30), the heads or nuts of which are accessible by an element of at least one cavity (27) provided in at least one of the elements and at least one removable locking part ($C_1$, $C_2$) which engages into the cavity (27) by bearing upon the heads or the nuts, so as to ensure the captivity of the screws (30) and to avoid that the assembly be able to dissociate during use.

8 Claims, 3 Drawing Sheets

ELONGATED VIBRATOR MADE IN SEVERAL DETACHABLE ELEMENTS ASSEMBLED WITH EACH OTHER THROUGH SECURED CONNECTIONS

BACKGROUND OF THE INVENTION

1. Field of the Invention

The present invention relates to an elongated vibrator made in several detachable elements assembled with each other through secured connections.

It more particularly applies to elongated vibrators notably used in methods for improving soils such as vibro-compaction, (vibro-floatation) or vibro-substitution for possibly making ballasted columns.

2. Description of the Prior Art

Generally, it is known that the elongated vibrators currently used today, consist of a tubular element which may comprise one or more sections, the upper end of which is provided with means for suspension from a hoisting and/or guiding machine and the lower end of which is connected to an endpiece successively including a damper-isolator of vibrations, a generator of vibrations and a tip provided with a protective shell.

The generator of vibrations comprises one or more eccentric flyweights rotatably mounted around the longitudinal central axis of the elongated vibrator and driven into rotation by a hydraulic or electric motor, via a coupling, or even a train of gears at a speed of rotation of the order of 1,500-3,500 rpm. The centrifugal force generated by these flyweights is exerted omnidirectionally in a plane perpendicular to the longitudinal median axis of the elongated vibrator. The order of magnitude of the centrifugal force is typically from 100 to 500 kN depending on the models.

Many technical constraints are applied to the elongated vibrator:

- the centrifugal force generates strong mechanical stresses in the constitutive parts,
- the thereby generated vibration creates problems of fatigue of the materials, as well as an increased risk of loosening of the screwed assemblies,
- the elongated vibrator is subject to friction of the ground: all the external surfaces undergo very strong abrasion,
- constraints on weight and bulkiness are added thereto,
- disassembling and reassembling should be easy in order to limit stopping times on site in the case of breakdown and to limit operating costs.

All these constraints make the design delicate. Reliability of the equipment is often uncertain.

Assemblies of the screw type are not very reliable because of the increased risk of unscrewing and of abrasion of the ground which may be exerted on the screw head, the nut or the thread itself.

The assembly type the most currently used is welding but this makes disassembly difficult, or even impossible.

Now, because of the high stresses which it undergoes, the generator of vibrations has to be able to be disassembled in order to ensure its maintenance.

OBJECT OF THE INVENTION

The object of the invention is therefore more particularly to solve this problem. For this purpose, it proposes an elongated vibrator of the aforesaid type comprising an end-to-end assembly of at least two coaxial elements.

SUMMARY OF THE INVENTION

According to the invention, this assembly involves a plurality of fixing screws, the heads or the nuts of which are accessible by means of at least one cavity provided in at least one of said elements and at least one removable locking part which engages into said cavity by bearing upon said heads or said nuts, so as to ensure the captivity of said screws and to avoid that the assembly may dissociate during use.

This locking part further has the advantage of providing complementary protection to the assembly screws.

Advantageously, the vibrator may comprise protective means designed so as to cover at least the junction area between both elements while thereby maintaining the locking part in said cavity and accordingly protecting the attachment means of this locking part inside the cavity.

Thus, all the means which intervene for attaching both elements of the elongated vibrator are protected and do not undergo any wear, which facilitates subsequent disassembly.

Moreover, the aforesaid cavity may consist in an annular groove provided in one of the two elements or even in a flange used for connecting both elements.

BRIEF DESCRIPTION OF THE DRAWINGS

An embodiment of the invention will be described hereafter, as a non-limiting example, with reference to the appended drawings wherein.

DESCRIPTION OF THE PREFERRED EMBODIMENTS

Figure 1:
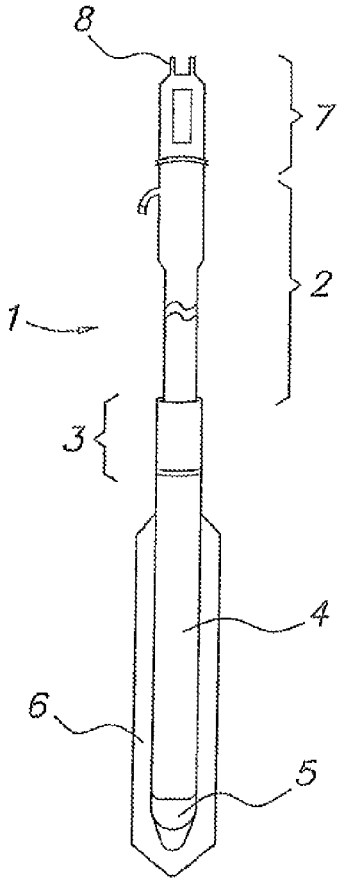
FIG. 1 is a schematic elevational view of an elongated vibrator.

In this example, the elongated vibrator 1 successively consists of:

- a tubular upper portion 2 which may comprise one or more elements (extension pieces) for example of five meters in length,
- a vibration damper 3,
- a generator of vibrations 4,
- a tip 5, and
- two protective shells 6 covering a portion of the generator of vibrations 4.

The tubular upper portion 2 is equipped at its upper end with a hoisting head 7 provided with a pulley 8 as well as with connections for water or compressed air supply circuits of an assistance launching system with a water or air jet. This pulley 8 may be replaced by an attachment device sliding on a guiding mast.

The damper 3 is designed in order to entirely filter the vibrations towards the machine for hoisting the elongated vibrator which is used (crane or mast).

The vibration generator 4 appears as a cylindrical element including a cylindrical section 10 and a module for generating vibrations 11 containing the eccentric flyweights as well as the optional gearing ensuring its driving into rotation. The motor 12 coupled with this gearing may consist in a hydraulic motor or an electric motor: this motor 12 may optionally be designed so as to allow variation of its speed of rotation.

The module for generating vibrations 11 is itself connected to the tubular section 10 which is notably used for receiving elements for powering and controlling the motor 12.

The elongated vibrator 1 described earlier may be mounted in a pendular mode on a crane, the cable of the crane passing around the pulley 8 of the hoisting head 7. Under the effect of vibrations generated by the vibration generator, it sinks into the ground because of its own weight. This sinking may be assisted by water or air launching (injection of water or air at the tip 5 and/or at the protective shell 6).

Nevertheless, the elongated vibrator may be mounted on a guiding mast. In this case, it may be subject to an additional sinking force generated by an actuator which may consist in a cylinder or even a system with winch/return pulleys.

As mentioned earlier, this elongated vibrator may be used for vibro-compaction of loose soils and for vibro-substitution (flexible inclusion) or even for making ballasted columns.

Figure 2:
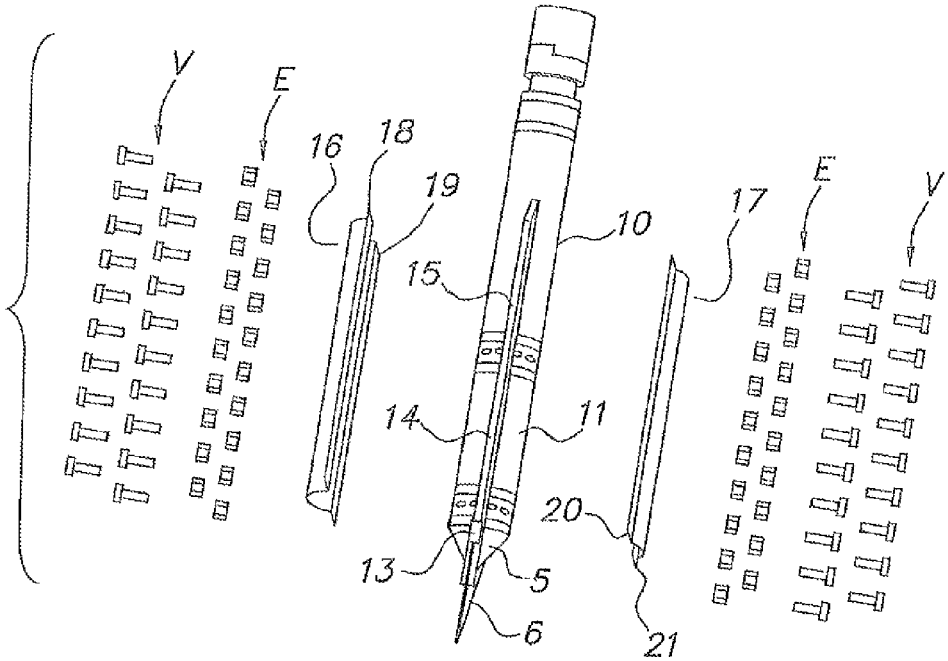
FIG. 2 is a schematic partial perspective illustration of this elongated vibrator after disassembling the protective shell.
Figure 3:
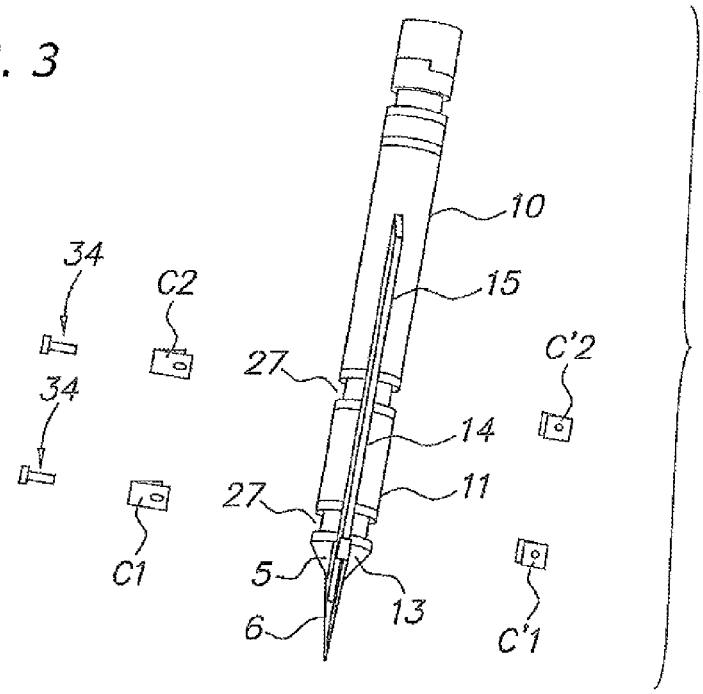
FIG. 3 is an illustration analogous to that of FIG. 2 illustrating the disassembly of the two pairs of half-crowns which form the locking parts of the screws for assembling the module for generating vibrations on the cylindrical section and on the tip of elongated vibrator, respectively.
Figure 5:
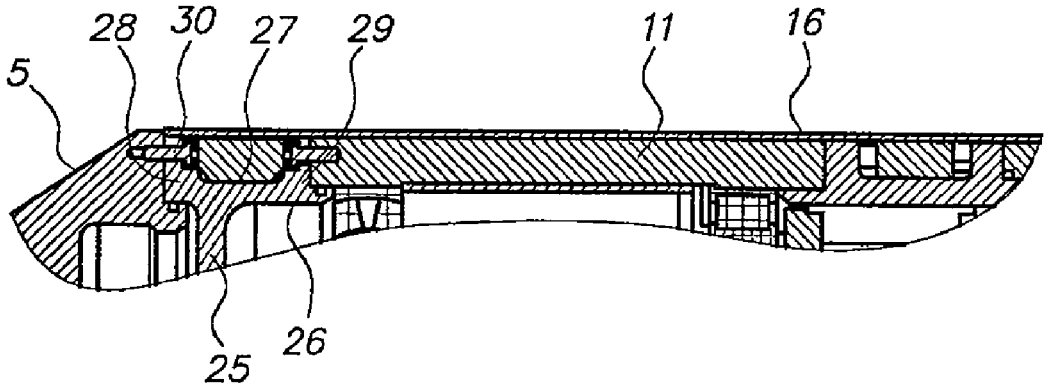
FIG. 5 is a partial sectional view showing the assembly of the module for generating vibrations on the cylindrical section and on the tip of the elongated vibrator.
Figure 6:
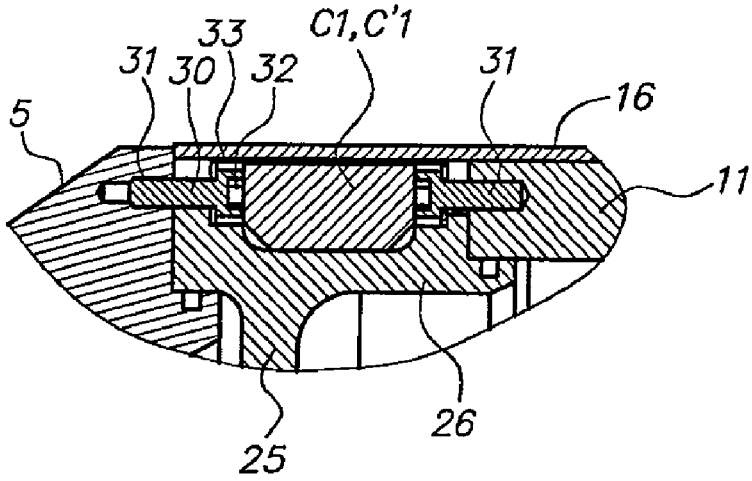
FIG. 6 is a view at a larger scale showing the assembly of the generator on the tip of the elongated vibrator.

As illustrated in FIGS. 2-6, the tip 5, the vibration generating module 11 and the tubular section 10, each comprise two diametrically opposite ridges 13, 14, 15, respectively. In the assembled position, the homologous ridges 13, 14, 15 are aligned in order to form two ribs used for ensuring attachment by screwing of two protective shells 16, 17. These two protective shells 16, 17 are made in metal sheet and have a substantially hemicylindrical shape, provided with two radially protruding side edges 18, 19, 20, 21, intended to be supported and fixed by screwing (screw V, nuts E), on the radial faces of the ridges 13, 14, 15, as illustrated in FIG. 2.

The assembly of the vibration generating module 11 on the tip 5 is ensured by means of a circular flange 25 with an axial section in the shape of an overturned H, the parallel wings of which 26 are provided with an annular cavity 27 with a rectangular axial section axially delimited by two radially protruding circular crowns 28, 29.

Each of these crowns 28, 29 is provided with a plurality of counter-bored axial perforations on the side of the cavity 27. These perforations are each intended to receive a fixing screw 30 which will screw into a tapped axial bore 31 provided, depending on the case, in the tip and in the module for generating vibrations. At the end of the screwing, the head 32 of the screw engages into the counter-bore 33, the depth of which is substantially equal to the height of said head 32.

Advantageously, in order to be able to carrying out screwing, the head 32 will be provided with an axial imprint suitable for a wrench or a screwing endpiece of a conventional type.

The captivity of the fixing screws 30 is ensured by means of locking elements here formed by two half-crowns $C_1$, $C_2$-$C'_1$, $C'_2$ with a rectangular axial section substantially mating that of the cavity 27 into which they will engage with quasi-zero play.

Therefore, the screws 31 cannot unscrew beyond this play.

The two half-crowns $C_1$, $C'_1$-$C_2$, $C'_2$ of each of the locking elements may be attached to each other, for example by screwing by means of screws 34. Nevertheless, this attachment remains optional insofar that these half-crowns $C_1$, $C'_1$-$C_2$, $C'_2$ are retained captive in the cavity 27 by the metal sheet of both protective shells 16, 17. These two protective shells 16, 17 ensure protection of the assembly formed by the module for generating vibrations 11 and the tubular section 10 of the external abrasion and therefore makes the half-crowns captive $C_1$, $C'_1$-$C_2$, $C'_2$.

A significant advantage of the solution described earlier, consists in that it allows easy access to the vibration generating module which forms a sensitive element of the elongated vibrator: the module for generating vibrations may easily be disassembled on site and shipped to the factory for its maintenance. It may easily be replaced. These assembly/disassembly operations do not affect in any way the strength of the elongated vibrator and its capability of transmitting vibrations.

Of course, the invention is not limited to the embodiment described earlier.

Figure 4:
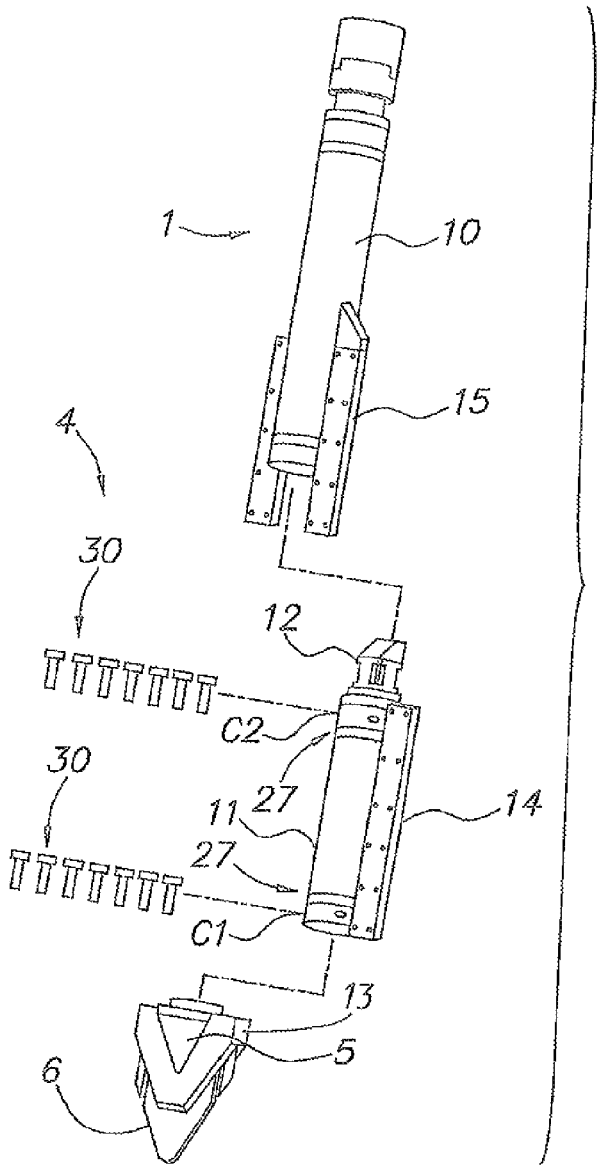
FIG. 4 is a schematic perspective view illustrating the disassembly of the module for generating vibrations.

Thus, for example:

the screws may be replaced by bolts and nuts, the protective metal sheets may have any shape, as far as they cover the half-crowns, the half-crowns may optionally be integrated into the protective shells, the two half-crowns may be replaced by crown fractions, for example three, four . . . fractions, the screws 30 may be implanted on a single side of the recess or on both opposite sides as in FIG. 4.

The invention claimed is:

1. An elongated vibrator made in several detachable elements, assembled end to end, this vibrator including a tubular element comprising one or more sections, the upper end of which is provided with means for suspension from a hoisting and/or guiding machine and the lower end of which is connected to an endpiece successively including a damper-isolator of vibrations, a generator of vibrations and a tip, at least one of the assemblies of the detachable elements involving a plurality of fixing screws, the heads or the nuts of which are accessible by means of at least one cavity provided in at least one of said elements, said vibrator further comprising at least one removable locking part which engages into said cavity by bearing upon said heads or said nuts, as well as means for attaching this locking part inside the cavity so as to ensure the captivity of said screws and to avoid that the assembly may be dissociated during the use.

2. The vibrator according to claim 1, comprising at least one protective shell designed so as to cover at least the junction area between both elements while thereby maintaining the locking part in said cavity.

3. The vibrator according to claim 1, wherein the aforesaid cavity consists in an annular groove provided in one of the two elements or even in a flange used for connecting both elements.

4. The vibrator according to claim 1, wherein the aforesaid tip and the aforesaid generator of vibrations each comprise two diametrically opposite ridges, and in comprising two substantially hemicylindrical protective shells, provided with two radially protruding side edges which will be attached on the side faces of both ribs formed by said ridges, both of the protective shells ensuring the captivity of the aforesaid locking part ($C_1$, $C'_1$-$C_2$, $C'_2$) inside said cavity (27).

5. The vibrator according to claim 1, wherein the assembly of the module for generating vibrations on the tip is ensured by means of a circular flange, provided with an annular cavity delimited by two radially protruding circular crowns, provided with a plurality of counter-bored axial perforations on the side of the cavity, and in that said perforations are each intended to receive a fixing screw which will be screwed into a tapped axial bore provided, depending on the case, in the tip and in the module for generating vibrations, the counter-bore of said perforations being intended to contain the head of the screws at the end of screwing.

6. The vibrator according to claim 5, wherein the captivity of the aforesaid fixing screws is ensured by means of at least one locking element engaging into the cavity.

7. The vibrator according to claim 6, wherein the locking element is formed by two half-crowns with an axial section substantially mating that of the cavity.

8. The vibrator according to claim 7, wherein both half-crowns are attached to each other by screwing.

* * * * *